US006494763B1

(12) United States Patent
Hastey

(10) Patent No.: US 6,494,763 B1
(45) Date of Patent: Dec. 17, 2002

(54) LIFE-LIKE DOLL

(76) Inventor: Sullivan Hastey, 2028 Jaybrook Dr., Rancho Palos Verdes, CA (US) 90275-2034

( * ) Notice: Subject to any disclaimer, the term of this patent is extended or adjusted under 35 U.S.C. 154(b) by 0 days.

(21) Appl. No.: 09/822,988

(22) Filed: Mar. 30, 2001

(51) Int. Cl.[7] ..... A63H 3/46
(52) U.S. Cl. ..... 446/376; 446/382; 446/383
(58) Field of Search ..... 446/369, 370, 446/371, 372, 376, 378, 97, 102, 103, 124, 126, 382, 383

(56) References Cited

U.S. PATENT DOCUMENTS 1,595,203 A * 8/1926 Leathers ..... 446/375
3,009,284 A 11/1961 Ryan
3,234,689 A 2/1966 Ryan
4,268,991 A 5/1981 Cotey et al.
4,662,857 A 5/1987 Quinn et al.
4,968,282 A 11/1990 Robson et al.
5,630,745 A 5/1997 Yeh
6,033,284 A 3/2000 Rodriguez Ferre
6,074,270 A 6/2000 Wilcox et al.
6,110,002 A 8/2000 Langton

* cited by examiner

*Primary Examiner*—Kien T. Nguyen
(74) *Attorney, Agent, or Firm*—Perkins Coie LLP

(57) ABSTRACT

A life-like doll has a soft body to better simulate the characteristics of a human body. The doll has an internal structure, which allows for life-like movement and positioning or posing. The internal structure includes sections or segments connected together by pivot, twist or ball joints. The joints have sufficient resistance to movement, via friction or a detent, to hold the limbs and torso of the doll into given posed positions. The soft body covers and conceals the internal structure, so that the doll has a life-like appearance.

14 Claims, 7 Drawing Sheets

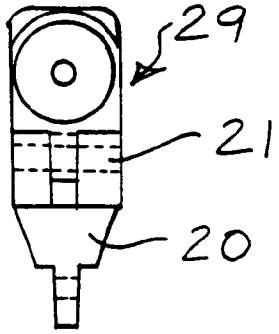
Fig. 6B
Fig. 6A
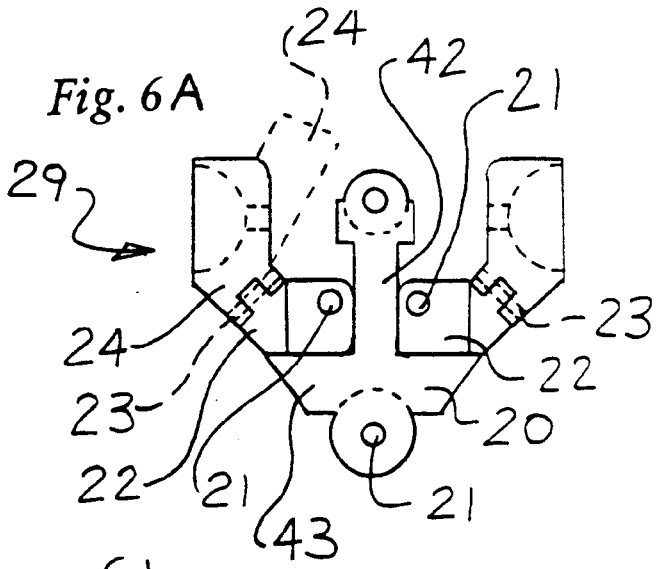
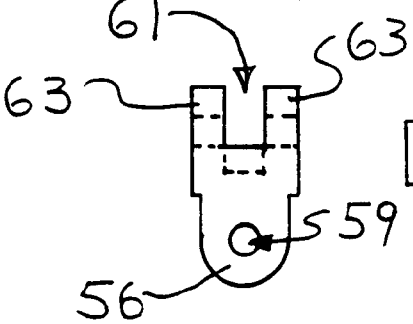
Fig. 7B
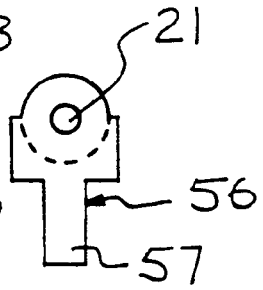
Fig. 7A
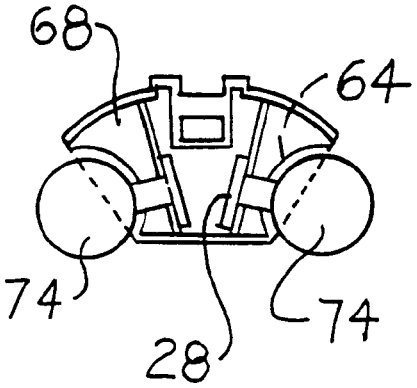
Fig. 8
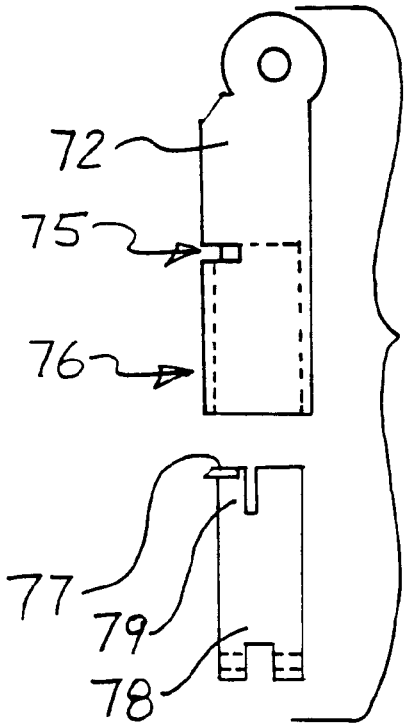
Fig. 9

LIFE-LIKE DOLL

The field of the invention is dolls or small scale replicas of human figures.

BACKGROUND OF THE INVENTION

Dolls having movable arms, legs and heads have long been known, primarily as children's toys, but also as collectibles. These types of dolls have typically been manufactured of plastic or other hard material. Many of them have arms, legs or heads capable of limited movement. Due to the construction of the joints between the limbs and torso, or within the limbs themselves, such as an elbow or knee joint, these types of known dolls have limited ranges of movement, positions or poses. Accordingly, they generally cannot simulate many typical action or resting position of real people in day to day living. For example, many dolls cannot simulate the real life human movement of legs crossing, bending at the waist, or moving the arms to cover the face or chest. Accordingly, while these types of dolls have achieved varying degrees of success, disadvantages remain relating to their limited ranges of movement and position.

Another drawback of many existing dolls is that they have visible joints. While various joints or connections between limbs have been used in different dolls to allow the limbs to pivot or rotate relative to the torso, these joints are generally visible. Consequently, when the doll is undressed, or only partially dressed, or even wearing clothing not covering, e.g., the elbow or knee joints, the realism which doll designers strive for, is degraded. Accordingly, disadvantages remain relating to the visible or exposed body joints of the doll.

While a large variety of materials have been used to manufacture doll bodies, hard plastic materials have been most commonly used. While these types of plastic materials have certain advantages, they provide little, if any, simulation of a real human body. Typically, such plastic materials result in relatively hard and rigid doll body components, in contrast to the softer and more pliable characteristics of real human skin and flesh. Consequently, disadvantages remain as well in providing a doll having a more life like body texture or feel to the touch.

Accordingly, it is an object of the invention to provide an improved doll. Other and further objects and advantages will appear below. The invention resides as well in subcombinations of the components and assemblies described.

SUMMARY OF THE INVENTION

To these ends, a doll includes an internal structure having a plurality of sections, with each section pivotably attached to an adjoining section. A doll body, in the form of a human figure, surrounds the internal structure, substantially on all sides. The doll body is a soft and flexible material, such as silicone rubber. The sections of the internal structure are moveable, relative to each other, to allow the limbs of the doll body to be moved into a wide variety of positions, including positions which real people assume, in every day living. As a result, the enjoinment or entertainment value of the doll, whether as a toy or a collectible, is improved, as the internal structure and doll body provide for a doll more closely simulating a real human.

In a second a separate aspect of the invention, the sections of the internal structure are connected to each other via pivotable, rotatable, twistable or ball-type joints. The doll body surrounds or overlays the joints, on all sides. As a result, the joints between the sections of the internal structure are not visible. This provides for a more life like appearance of the doll, especially at the joint areas, such as the knee or elbow.

In a third and separate aspect of the invention, the soft and flexible material of the doll body more closely simulates the touch characteristics of real human skin and flesh, providing a more life like doll.

In a fourth and separate aspect of the invention, the doll is posed within a container or box. This allows the doll to be placed into a variety of true-life poses or positions, for display (e.g., at a point of sale) or for use by the doll owner. The posability of the doll also allows the doll to interact with, or use, various accessories, or props, within the box or container, to provide a more interesting and attractive display.

BRIEF DESCRIPTION OF THE DRAWINGS

In the drawings, wherein the same reference number indicates the same element, throughout the several views:

FIG. 6A is a front view of the chest frame of the internal structure shown in FIG. 5.

FIG. 6B is a side view thereof.

FIG. 7A is front view of a neck or spine section of the internal structure shown in FIG. 5

FIG. 7B is a side view thereof.

FIG. 8 is a partially cut away front view of the pelvis or hip section of the internal structure shown in FIG. 5.

FIG. 9 is a partial front view of a leg or thigh section of the internal structure shown in FIG. 5.

DETAILED DESCRIPTION OF THE DRAWINGS

Although specific embodiments of the invention will now be described with reference to the drawings, it should be understood that various changes and modifications may be made without departing from the spirit, scope and contemplation of the invention. Indeed, the drawings are provided by way of example, and not by way of limitation.

Figure 1:
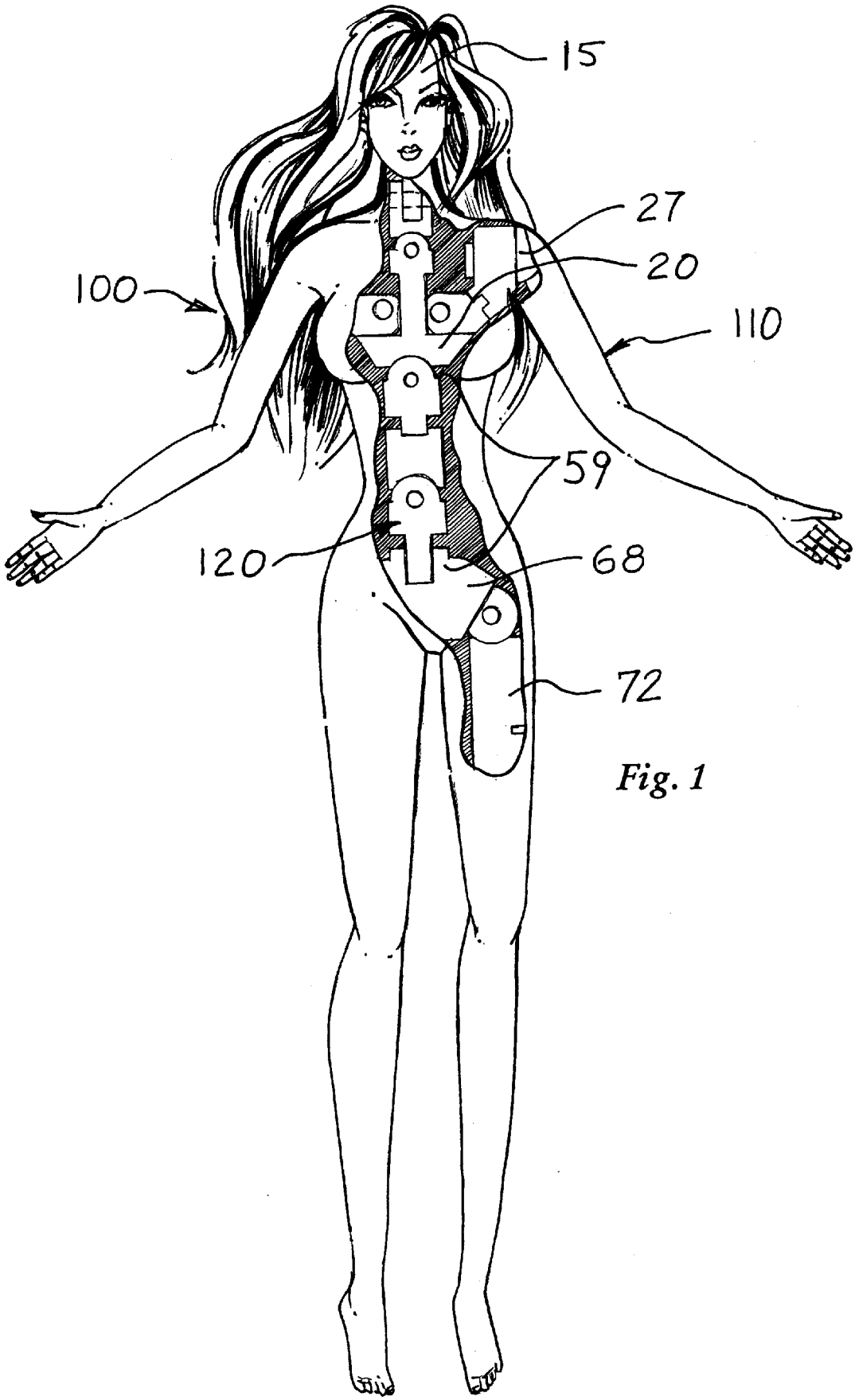
FIG. 1 is a partially cut away perspective view of a preferred embodiment of the doll of the present invention.
Figure 2:
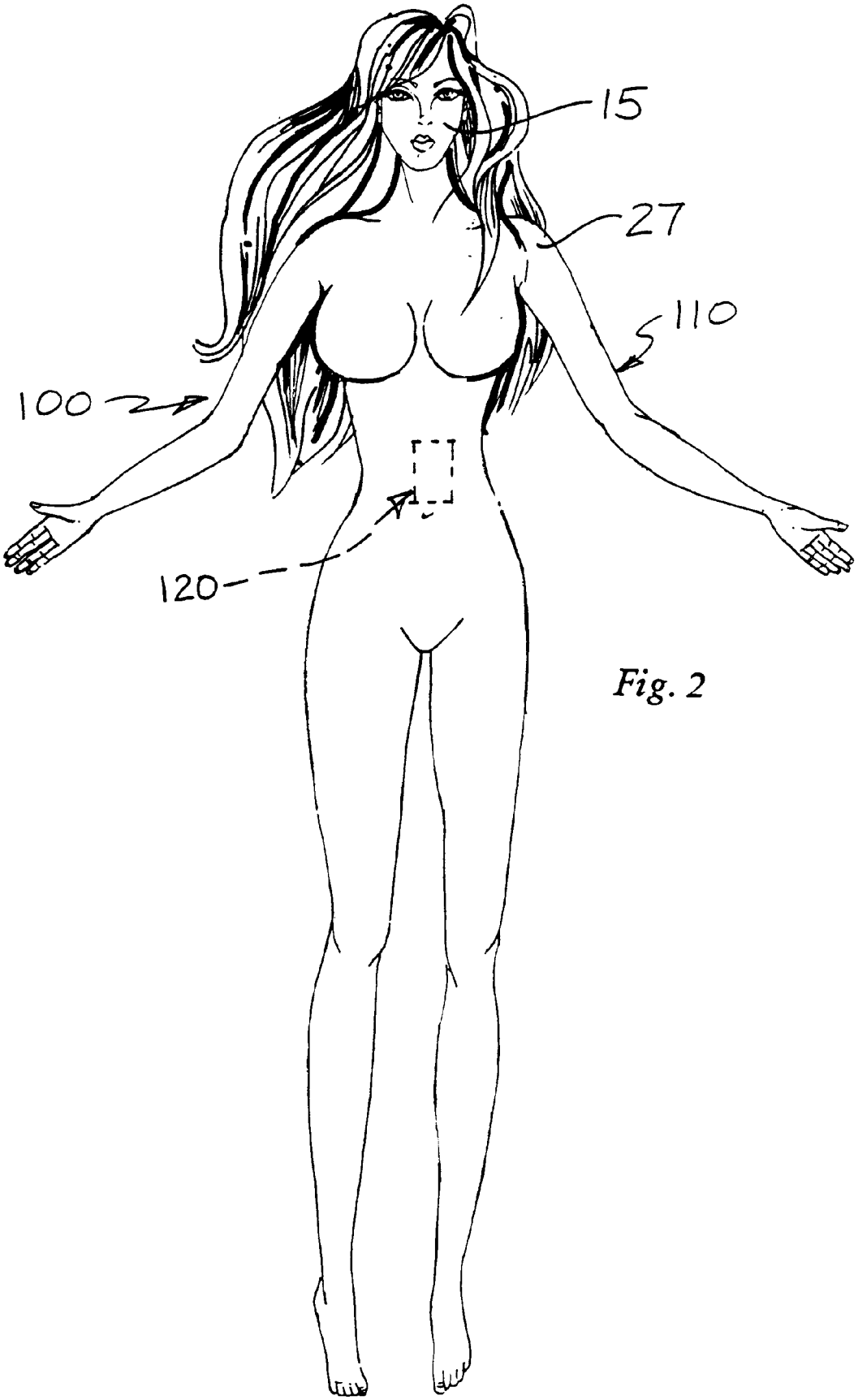
FIG. 2 is a perspective view of the doll of FIG. 1.

Turning now to FIGS. 1 and 2, the present doll 100 may take various forms, and is illustrated, by example, as a female human figure. The doll 100 has an internal structure, frame or skeleton 120, which is partially shown in FIG. 1. As shown in FIG. 2, the internal structure 120 is entirely covered or concealed by the doll body 110. The doll body 110 is preferably a soft and flexible material, such as e.g., silicone rubber, to provide a life-like appearance and feel. Other such materials, such as urethane, silicone-urethane mixtures, vinyl, or polymer plastics may also be used Turning to FIG. 5, the internal structure 120 includes a plurality of components, sections, or segments, attached to each other, in ways which allow the internal structure 120 to move into various life-like positions. The internal structure 120 is symmetrical, side to side, along the center line CC. Accordingly, the description below of the left side of the internal structure 120 also describes the right side as well.

A shoulder link or section 22 is a pivotably connected to a chest frame 20 about a vertical pivot joint 21. A shoulder socket frame 24 is pivotably connected to the shoulder link 22 along a longitudinal pivot joint 23. The vertical pivot joint 21 allows the shoulder link 22 to pivot vertically relative to the chest frame 20, while the longitudinal pivot joint 23 allows the shoulder socket frame 24 to pivot longitudinally (i.e., front to back) relative to the chest frame 20.

An upper arm link 30 has a ball 26 secured into a ball socket in the shoulder socket frame 24 by a groove retainer 28. As a result, the upper arm link 30 can pivot both vertically and longitudinally relative to the chest frame 20. A twist link 34 is pivotably attached to the upper arm link 30 via a twist joint 32. The twist joint 32 allows the twist link 34 to pivot about axis or line A—A, in FIG. 5. A forearm 38 is pivotably attached to the twist link 34 at an elbow joint 36. A hand 40 is pivotably attached to the forearm 38 via a hand joint 42, which may be a single axis pivot joint, or a dual axis ball joint.

Figure 5:
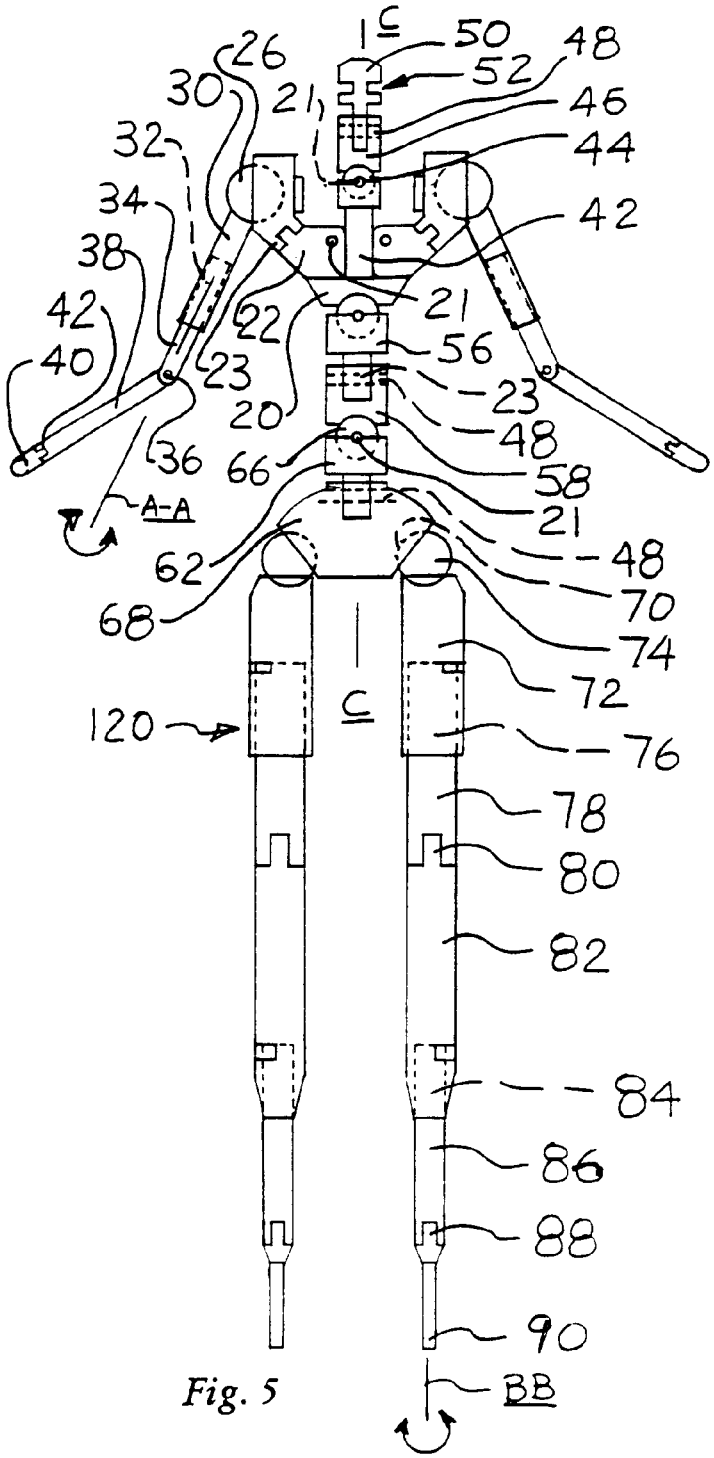
FIG. 5 is a front view of the internal structure shown in FIGS. 1 and 3.

Referring still to FIG. 5, a neck section 46 is pivotably attached to the chest frame 20 via a vertical or lateral pivot joint 21. A head post 50 is pivotably attached to the neck section 44 via a longitudinal pivot joint 48. A groove 52 in the head post 50 provides an attachment surface for the head 15 (shown in FIG. 1).

Figure 4:
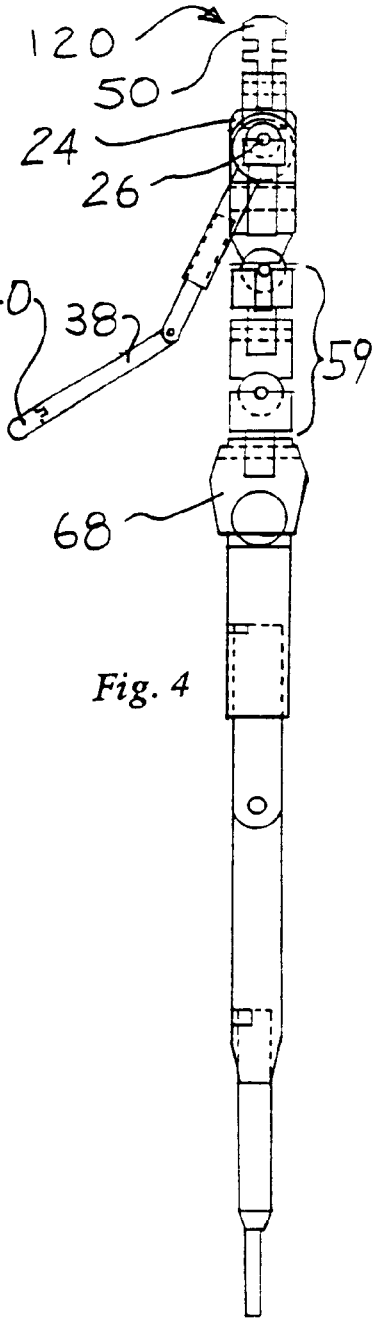
FIG. 4 is a side view thereof.

An upper spine section 56 is attached to the chest frame 20 via a vertical or lateral pivot joint 21. A middle spine section 58 is pivotably attached to the upper-spine section 56 via a longitudinal pivot joint 48. Similarly, a lower a spine section 62 is pivotably attached to the middle spine section 58 via a vertical or lateral pivot joint 21. The spine sections 56, 58, and 62 and their joints 21 and 23 form a spine assembly, generally designated as 59 in FIG. 4.

A hip section 68 is pivotably attached to the lower spine section 62 with a longitudinal pivot joint 48. The hip section 68 includes hip sockets 70. A thigh link 72 has a hip ball 74 retained within the hip socket 70, to form a hip joint, similar to the shoulder joint formed by the shoulder ball 26 and socket frame 24, as described above. A leg link 78 is pivotably attached to the thigh link 72 with a leg twist joint 76. The leg link 78 can therefore pivot about line B—B. A knee link 82 is pivotably attached to the leg link 78 at a pivotable knee joint 80. The knee joint 80 is a longitudinal movement joint, in that it allows front to back movement between the leg link 78 and knee link 82. However, unlike the longitudinal pivot movement 23 between the shoulder link 22 and the shoulder socket frame 24, or the longitudinal pivot joints 48, the knee joint 80 preferably allows the knee link 82 to pivot only behind the leg link 78, thereby simulating a human knee joint.

A foot link 86 is pivotably attached to the knee link 82 through a foot twist joint 84. This allows the foot link 86 to twist relative to the knee link 82 and thigh link 72. A foot 90 is pivotably attached to the foot link 86 at an ankle joint 88. The ankle joint 88may be similar to the other single axis longitudinal pivot joints 48, to allow up/down movement of the foot 90. Alternatively, the ankle joint 88 may be a ball joint, to provide up/down and roll (side to side) movement of the foot 90 relative to the foot link 86.

Referring to FIGS. 6A and 6B, the shoulder links 22 can pivot up about the joints 21, to raise the shoulders 27 of the doll 100, and move them towards each other, in a shoulder shrugging movement or position. In addition, the socket frames 24 can pivot front or back about the joints 23, to allow the shoulders 27 to roll forward or back. Consequently, the entire shoulder assembly generally designated 29 (which includes the chest frame 20, shoulder links 22, shoulder socket frames 24 and the joints 21 and 23) provides for realistic shoulder movement of the doll 100. The chest frame 20 has an upright section 42 extending a right angles from a base 43, as shown in FIG. 6A. In the normal or resting position, the shoulder links 22 are bottomed out or flush against the base 43 of the chest frame 20. Vertical pivoting movement of the shoulder links 22 may be limited by the upright section 42.

Referring to FIGS. 7A and 7B, the upper and lower spine sections 56 and 60 have a flange 57 with a through hole 59, forming part of the pivot joint 21. A slot 61 is formed between flange plates 63, spaced apart to receive the flange 57 of an adjacent spine section° Friction may be created in the various pivot joints by having the flange 57 dimensioned to be slightly wider than the groove 59, so that the sides of the groove 59 press in slightly on the flange 57, creating a friction joint.

Turning now to FIG. 8, the hip or pelvis section 68 advantageously has a hollow interior, to accommodate the retainers 28 holding the hip balls 74 in place. As shown in FIG. 9, the leg twist joint 76 is formed by providing a slot 75 in the thigh link 72. A lip or protrusion 77 on a tongue 79 of the leg link 78 is adapted resiliently to extend into the slot 75. The leg link 78 is attached to the thigh link 72 by depressing the tab 79, sliding the leg link 78 into the thigh link 72, and allowing the tab 77 to move back outwardly and into the slot 75. The angle subtended by the slot 75 determines the pivot range provided by the twist joint 84. The twist joints 76 and 32 may have a similar construction.

Figure 3:
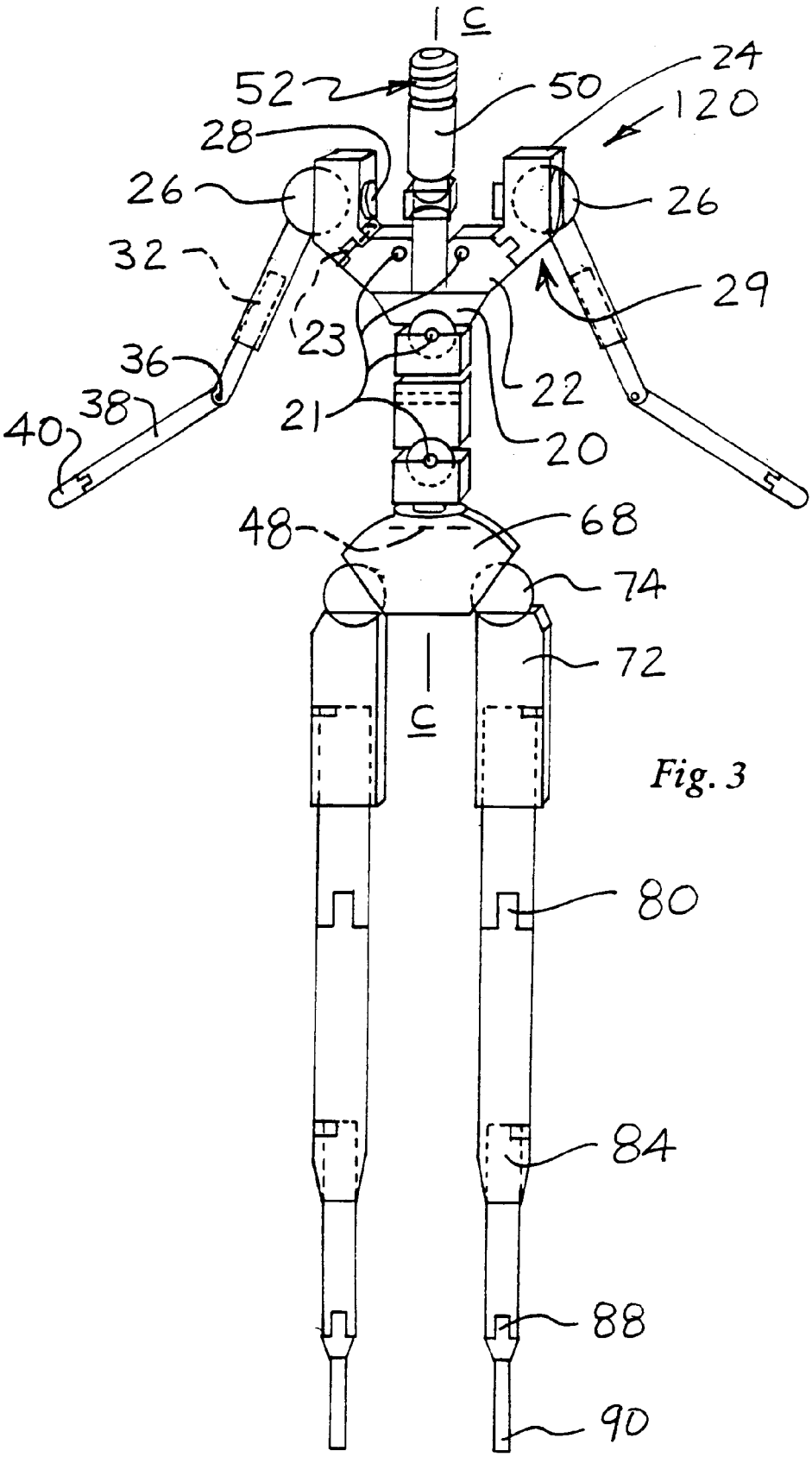
FIG. 3 is a perspective view of the internal structure of the doll shown in FIG. 1.

Referring to FIGS. 1, 3 and 5, the head 15 of the doll 100 is preferably rotocast in a mold. The face is then painted. The head 15 is placed or snapped onto the neck section 50, with an internal lip of the head 15 seating within the groove 52, to secure the head 15 onto the internal structure 120.

The various sections and components of the internal structure 100 are preferably made of hard plastic, and may be injection molded. The various pivot joints maintain the internal structure into whatever pose it may be placed. The pivot joints may function via friction, e.g., using spring pins, press fit, etc. or may have detents, i.e., a mechanical design allowing movement between spaced apart discrete positions, and requiring increased force to change between positions.

In a preferred method for manufacture of the doll 100, the internal structure 120 is first assembled by attaching the various components together via the joints described above. The internal structure 100 is then placed into a mold. The mold is shaped as the negative of the desired shape of the body 110 of the doll 100 (with allowances for expansion or shrinkage of the molded body material, and draft, if any). The mold surfaces are smooth, so that the doll body 110 is produced with smooth exterior surfaces, simulating smooth skin. The mold is then filled with the body material, such as silicone rubber. This may be performed as a pour casting or gravity molding process, or as an injection molding process (for quicker manufacture of larger quantities). The mold surface may preferable be textured, e.g., by bead blasting, with very fine indentations. This texturing is helpful in removing glare and adding a silky and more life-like look and feel to the "skin" or the a surface of the body material.

The body material can be colored as desired, using additives. The internal structure 120 may have external features, such as serrations, teeth, grooves, etc., to better hold the body material onto the internal structure 120. The body material is allowed to cure or solidify. The mold is then opened and the doll 100 removed. The head 15 is then attached, to provide the fully assembled doll, as shown in FIG. 2. The doll 100 may be molded in a vertical or horizontal position. Inserts or pins may optionally be provided in the mold to hold the internal structure 120 in place, during the molding process.

After the body material 110 is molded onto the internal structure 120, all of the internal structure is covered and hidden from view, except for the head post 50, which is covered when the head 15 is attached. As a result, the external appearance of the doll 100 is as shown in FIG. 2, with the internal structure 120 entirely concealed. The body material 110 is flexible (and/or stretchable and compressible). Consequently, it offers only limited resistance to movement, and little or no spring back or memory affect. Accordingly, when the limbs or torso of the doll 100 are moved into any given position, they will remain in that position due to the holding force provided within each of the joints. In addition, due to the combination of the pivot, ball and twist joints, the doll 100 can be posed into various life-like positions. As all of the joints of the internal structure 120 are concealed, the doll 100 has a life-like appearance, regardless of the clothing placed onto the doll. The body material 110 is continuous and forms an integral single piece unit, providing a realistic appearance. While the head 15 is a separate component, the seam or joint at the neck is concealed under the chin and by the hair, reducing or eliminating the visibility of the joint between the head 15 and body 110. The doll 100 is preferably 8–16, 10–14, 12 or 13 inches tall.

Figure 10:
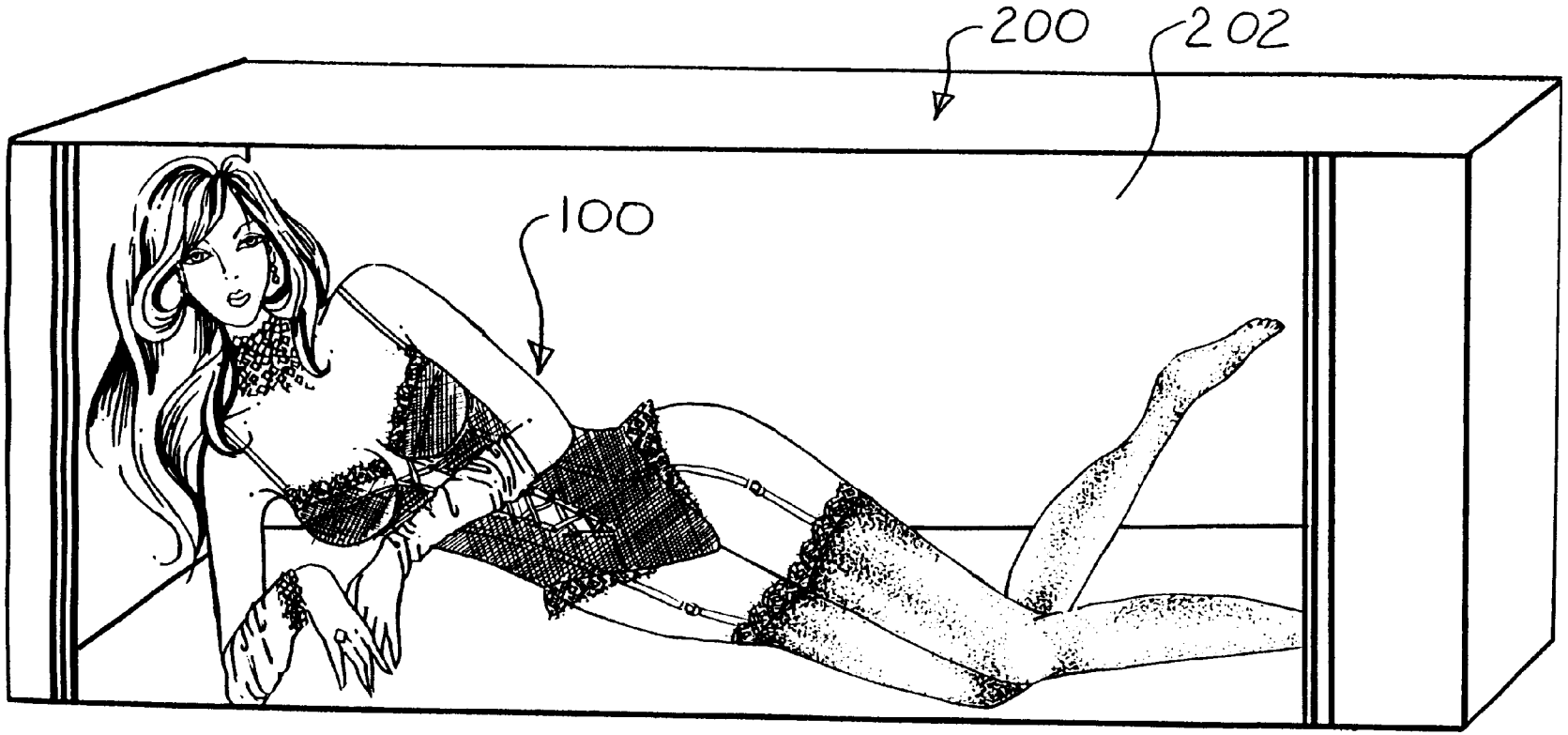
FIG. 10 is a perspective view of the doll of FIG. 2, within a package or box, for shipping, storage, or display, with the doll posed in a natural human-like position.
Figure 11:
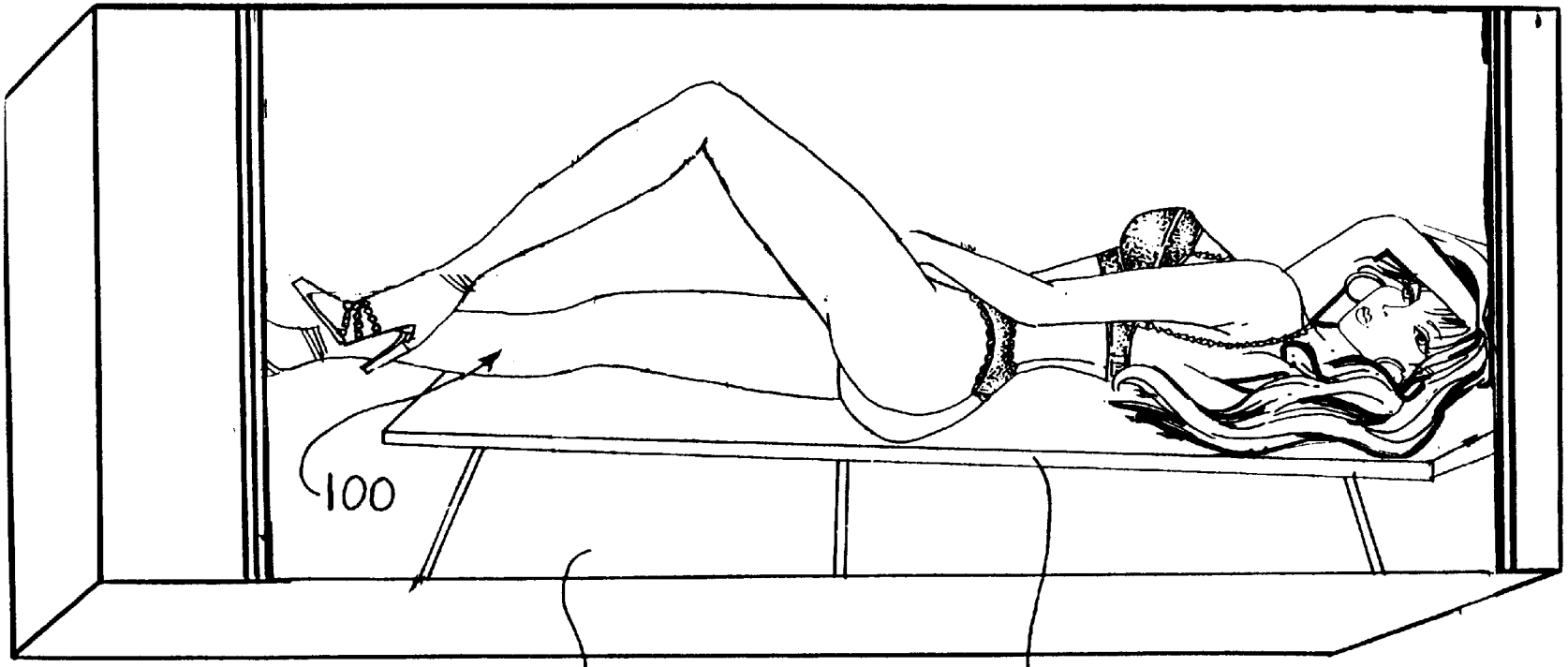
FIG. 11 is a perspective view of another doll and package embodiment, with the doll of FIG. 2 posed in another natural position, with an accessory.

Referring now to FIGS. 10 and 11, the doll 100 may be provided with a package or box 200 having a transparent front panel or surface 202. This allows the doll 100 within the box 200 to be visible, while on display, in a store, in a collection, etc. The doll 100 is preferably posed within the box 200, to provide a more creative appearance, in contrast to the straight standing poses typically used with existing dolls. Accessories, such as furniture 204 may also be provided within the box 200, and with the doll 100 posed using or otherwise interacting with the accessory 204.

What is claimed:

1. A poseable doll comprising:

an internal structure, including:

a shoulder section that can be posed in an upward, forward and backward position;

a spine assembly connected with the shoulder section, the spine assembly including a series of interconnected hinge joints, with the hinge joints providing friction to allow for holding the spine assembly into a posed position;

a pelvis section connected to the spine assembly via a pivot joint;

a thigh section having a ball secured into a ball socket in the pelvis section;

a leg link pivotably attached to the thigh section via a twist joint; and a molded doll body in the form of a human figure, surrounding the internal structure on substantially all sides, where the doll body comprises a soft and flexible material.

2. The doll of claim 1 where the material comprises silicone rubber.

3. The doll of claim 1 where the internal structure includes a shoulder assembly including a shoulder link pivotably attached to a chest frame, and a shoulder socket frame pivotably attached to the shoulder link, with the shoulder assembly vertically movable on the doll, via pivoting of the shoulder link on the chest frame.

4. The doll of claim 1 where the thigh section of the internal structure is attached to the pelvis section with sufficient friction to hold the sections in position relative to each other.

5. A poseable doll comprising:

a soft body made out of a flexible material to allow for lifelike appearance, feel, and movement;

an internal structure within the body, the internal structure including a plurality of sections connected via joints, to simulate the degrees of freedom of movement of at least a part of a human;

with the joints substantially entirely encapsulated within the body: and with the internal structure comprising:

a shoulder section that can be posed in an upward, forward and backward position;

a spine assembly connected with the shoulder section, the spine assembly including a series of spine sections interconnected with hinge joints, with hinge joints providing friction to allow for holding the spine assembly into a posed position;

a pelvis section connected to the spine assembly via a pivot joint;

a thigh section having a ball secured into a ball socket in the pelvis section; and a leg link pivotably attached to the thigh section via a twist joint.

6. The doll of claim 5, wherein the soft body is made out of silicone.

7. The doll of claim 5, with the ball socket providing a holding force for holding the thigh and pelvis sections in place relative to each other, unless the holding force is overcome by an external force applied to the doll.

8. The doll of claim 7 where a first spine section comprises a flange extending into a slot in a second spine section, and with a pin passing through the flange and slot, to hold the first and second spine sections together.

9. The doll of claim 8 where the flange is wider that the slot, to provide friction against relative movement of the first and second spine sections.

10. The doll of claim 5, with the internal structure further including a shoulder section comprising:

a shoulder link attached to a chest frame of the internal structure, and pivotable about a first axis relative to the chest frame;

a shoulder socket frame pivotally attached to the shoulder link, and pivotable about a second axis, relative to the chest frame, and with first axis not parallel to the second axis.

11. The doll of claim 5 with the internal structure further including a head attached to the internal structure via a twist joint.

12. A poseable doll comprising:

a soft body;

a rigid internal structure within the body, including:

a shoulder section that can be posed in an upward, forward and backward position;

a spine assembly connected with the shoulder section, the spine assembly including a series of interconnected hinge joints respectively held together by a plurality of pins, with the joints providing friction to allow for holding the spine assembly into a posed position;

a pelvis section connected to the spine assembly via a pivot joint;

a thigh section having a ball secured into a ball socket in the pelvis section;

a leg link pivotably attached to the thigh section via a twist joint.

13. The doll of claim 12, wherein the doll is 8–16 inches tall.

14. A doll comprising:

an internal structure including:

a pelvis;

first and second thigh sections each having a ball secured into a ball socket in the pelvis section;

first and second leg links attached to the first and second thigh sections, respectively, via first and second twist joints;

a spine assembly attached to the pelvis section with a pivot joint, and with the spine assembly including a plurality of spine sections with each spine section connected to an adjacent spine section by a hinge joint, with the hinge joints providing friction to allow for holding the spine assembly into a posed position;

a shoulder assembly attached to the spine assembly, with the shoulder assembly poseable in up, forward and backward positions;

first and second arm links attached to the shoulder assembly;

a head post attached to the shoulder assembly;

a doll body surrounding the internal structure, with the doll body comprising a flexible material; and a head on the head post and pivotable relative to the doll body.

* * * * *